US011267256B2

(12) United States Patent
Tanase et al.

(10) Patent No.: US 11,267,256 B2
(45) Date of Patent: Mar. 8, 2022

(54) RECORDING DEVICE AND RECORDING METHOD

(71) Applicant: SEIKO EPSON CORPORATION, Tokyo (JP)

(72) Inventors: Kazuyoshi Tanase, Nagano (JP); Keisuke Morita, Nagano (JP); Kentaro Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 16/800,087

(22) Filed: Feb. 25, 2020

(65) Prior Publication Data

US 2020/0269599 A1 Aug. 27, 2020

(30) Foreign Application Priority Data

Feb. 27, 2019 (JP) ..... JP2019-034847

(51) Int. Cl.
*B41J 2/21* (2006.01)
*B41J 3/54* (2006.01)

(52) U.S. Cl.
CPC ..... *B41J 2/2114* (2013.01); *B41J 3/543* (2013.01)

(58) Field of Classification Search
CPC ..... B41J 2/2114; B41J 2/2117
See application file for complete search history.

(56) References Cited

U.S. PATENT DOCUMENTS

2011/0043560 A1* 2/2011 Tanoue ..... B41J 29/38 347/12
2012/0050356 A1 3/2012 Seki

FOREIGN PATENT DOCUMENTS

JP 2012-051210 A 3/2012

* cited by examiner

*Primary Examiner* — Scott A Richmond
(74) *Attorney, Agent, or Firm* — Global IP Counselors, LLP

(57) ABSTRACT

A recording device provides, when a first mode that is a recording mode for increasing concentration of black is selected, in a first nozzle row including first nozzles capable of discharging a first ink representing black by a single color or a mixed color, and a second nozzle row including second nozzles capable of discharging a second ink having a lower pigment concentration than a black ink and being an achromatic color, a nozzle unused region by a first nozzle not discharging a first ink and a second nozzle not discharging a second ink, between a first nozzle usage region including the first nozzle discharging the first ink onto the recording medium, and a second nozzle used region including the second nozzle for discharging the second ink onto a region of the recording medium onto which the first ink is discharged.

7 Claims, 13 Drawing Sheets

RECORDING DEVICE AND RECORDING METHOD

The present application is based on, and claims priority from JP Application Serial Number 2019-034847, filed Feb. 27, 2019, the disclosure of which is hereby incorporated by reference herein in its entirety.

BACKGROUND

1. Technical Field

The present disclosure relates to a recording device and a recording method.

2. Related Art

An image processing method is known with which overcoat printing of a transparent ink is performed on a black ink using pigments, to reduce glossiness of the black ink using pigments and increase Optical Density (OP) of black (see JP-A-2012-51210).

However, unless ensuring a drying time of the ink before the overcoat printing, it is difficult to increase black concentration. That is, in the overcoat printing in the past, increase of the black concentration was insufficient.

SUMMARY

A recording device includes a recording head including a first nozzle row, in which first nozzles configured to discharge a first ink representing black by a single color or a mixed color are arranged, and a second nozzle row, in which second nozzles configured to discharge a second ink having a lower pigment concentration than a black ink and being an achromatic color are arranged wherein the first nozzle row and the second nozzle row are arranged in a first direction, a carriage on which the recording head is mounted and which is configured to move in the first direction, a transport unit configured to transport a recording medium, that receives ink discharged from the recording head, in a second direction that intersects with the first direction, and a control unit configured to control the recording head, the carriage, and the transport unit, wherein the control unit, when, of a first mode that is a recording mode for increasing concentration of black, and a second mode that is a different recording mode from the first mode, the first mode is selected, performs recording on the recording medium with a nozzle unused region, in which the first nozzle does not discharge the first ink and the second nozzle does not discharge the second ink, set between a first nozzle used region of the first nozzle row for discharging the first ink onto the recording medium, and a second nozzle used region of the second nozzle row for discharging the second ink onto a region of the recording medium with the first ink discharged thereon.

DESCRIPTION OF EXEMPLARY EMBODIMENTS

An exemplary embodiment of the present disclosure will be described below with reference to the accompanying drawings. The drawings are merely illustrative for describing the present exemplary embodiment. Because the drawings are illustrative, they are not consistent with each other or are partially omitted in some cases.

Figure 1:
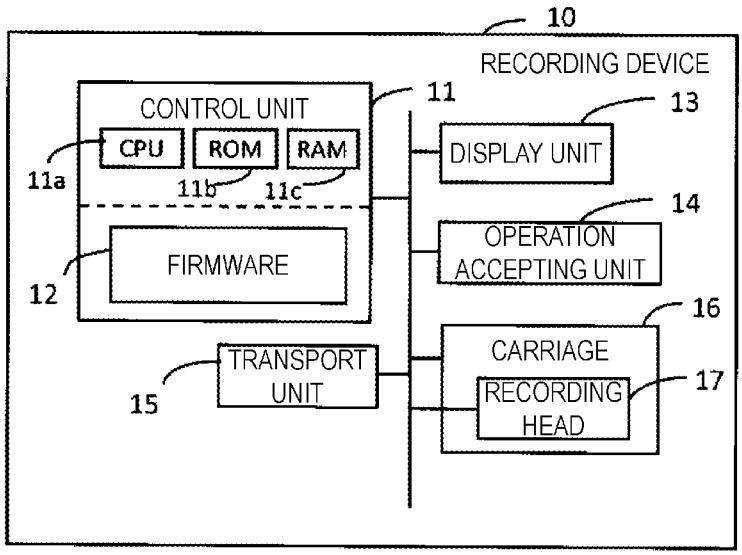
FIG. 1 is a block diagram simply illustrating a device configuration.

1. Overall Description of Device:

FIG. 1 simply illustrates a configuration of a recording device 10 according to the present exemplary embodiment. The recording device 10 may be described as a liquid ejecting device, a printing apparatus, a printer, or the like. The recording device 10 performs a recording method according to the present exemplary embodiment. The recording device 10 includes a control unit 11, a display unit 13, an operation accepting unit 14, a transport unit 15, a carriage 16, a recording head 17, and the like. The control unit 11 is configured to include one or more ICs having a CPU 11*a* as a processor, a ROM 11*b*, a RAM 11*c*, and the like, and other non-volatile memory, and the like.

In the control unit 11, the processor or CPU 11*a* controls the recording device 10, by executing arithmetic processing according to programs stored in the ROM 11*b*, other memory, or the like, using the RAM 11*c* or the like as a work area. The control unit 11 performs processing according to firmware 12, which is a type of program, for example. Note that, the processor is not limited to a single CPU, and a configuration may be adopted in which processing is performed by a plurality of CPUs, a hardware circuit such as an Application Specific Integrated Circuits (ASICs), or a configuration may be adopted in which a CPU and a hardware circuit cooperate to perform processing.

The display unit 13 is a means for displaying visual information, and, for example, is constituted by a liquid crystal display, an organic EL display, or the like. The display unit 13 may be configured to include a display, and a driving circuit for driving the display. The operation accepting unit 14 is a means for accepting an operation by a user, and, for example, is realized, by a physical button, a touch panel, a keyboard, and the like. Of course, the touch panel may be realized as a function of the display unit 13.

The display unit 13 together with the operation accepting unit 14 can be referred to as an operating panel of the recording device 10.

The transport unit 15 is a mechanism for transporting a recording medium. As is known, the transport unit 15 includes a roller (not illustrated) for transporting the recording medium from upstream to downstream of a transport path, a motor (not illustrated) for rotating the roller, and the like. The recording medium is typically a sheet, but may be a medium of a material other than paper as long as the medium is capable of being recorded by receiving liquid discharged.

Figure 2:
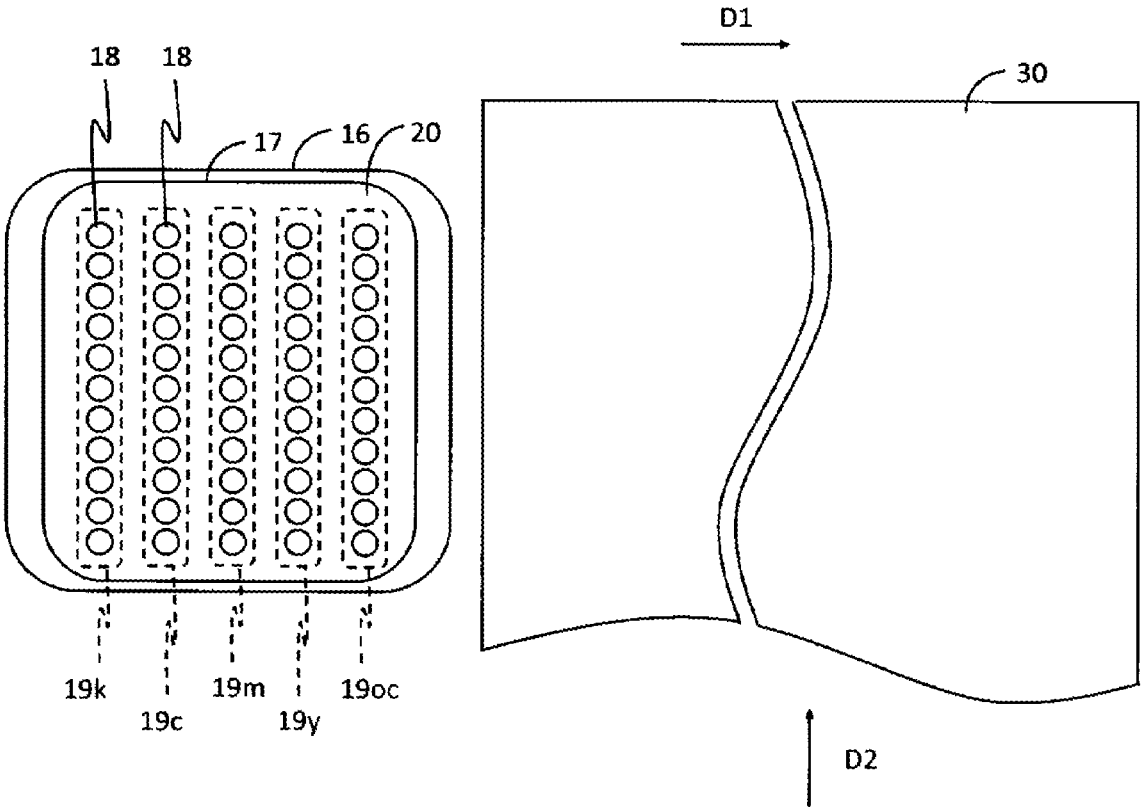
FIG. 2 is a diagram illustrating an example of an arrangement of nozzle rows included in a recording head.

The recording head 17 discharges liquid such as ink by an ink-jet method, and performs recording. As illustrated in FIG. 2, the recording head 17 includes a plurality of nozzles 18 capable of discharging ink, and discharges the ink onto a recording medium 30 transported by the transport unit 15 from each of the nozzles 18. Ink droplets discharged by the nozzle 18 are referred to as dots. However, in the following description, expression of dots is appropriately used, not only for ink droplets discharged by the nozzle 18, but also in image processing by the control unit 11 before the ink droplets are discharged by the nozzles 18. The control unit 11 controls application of a drive signal to a drive element (not illustrated) included in the nozzle 18 in accordance with print data, to cause the nozzle 18 not to eject or to eject dots.

FIG. 2 illustrates an arrangement example of a plurality of nozzle rows included in the recording head 17. Additionally, FIG. 2 simply illustrates a relationship between the recording head 17 and the recording medium 30. The recording head 17 may be described as a liquid ejecting head, a print head, a typing head, and the like. The recording head 17 is mounted on the carriage 16 that receives power from a motor (not illustrated) and is capable of reciprocating in parallel to a predetermined direction D1, and moves with the carriage 16. The movement of the carriage 16 is also referred to as a pass or a scan. The direction D1 corresponds to a "first direction". The direction D1 may be referred to as a main scanning direction D1. In the following, movement of the carriage 16 in the direction D1 is referred to as "forward movement", and movement of the carriage 16 in a reverse direction of the direction D1 is referred to as "backward movement".

The transport unit 15 transports the recording medium 30 in a direction D2 that intersects with the direction D1. The direction D2 corresponds to a "second direction". The direction D2 is also referred to as a sub scanning direction D2 or a transport direction D2. The "intersection" as referred to herein means being orthogonal. Of course, "orthogonal", "constant", and "parallel" mean not only exact orthogonal, constant, and parallel, respectively, but may also include errors that occur due to precision of manufacturing or assembling a product, and the like.

A reference numeral 20 denotes a nozzle surface 20 in which the nozzle 18 opens in the recording head 17. FIG. 2 illustrates an arrangement example of a plurality of nozzle rows on the nozzle surface 20. The recording head 17 includes a nozzle row for each ink color, in a configuration in which ink of each color is supplied from an ink holding means (not illustrated) called as an ink cartridge, an ink tank, or the like mounted in the recording device 10, and discharged from the nozzles 18. The nozzle row is constituted by the plurality of nozzles 18 for which a nozzle pitch, which is an interval along the direction D2 between the adjacent nozzles 18, is constant.

The recording head 17 includes, for example, a nozzle row 19*c* in which a plurality of the nozzles 18 for discharging a cyan (C) ink are arranged, a nozzle row 19*m* in which a plurality of the nozzles 18 discharging a magenta (M) ink are arranged, a nozzle row 19*y* in which a plurality of the nozzles 18 discharging a yellow (Y) ink are arranged, and a nozzle row 19*k* in which a plurality of the nozzles 18 discharging a black (K) ink are arranged. Furthermore, the recording head 17 includes a nozzle row 19*oc* in which a plurality of the nozzles 18 discharging a predetermined overcoat (OC) ink are arranged. Of course, the number of nozzle rows included in the recording head 17 is not limited to five illustrated in FIG. 2, and types of ink discharged by the recording head 17 are not limited to C, M, Y, K, and OC.

As illustrated in FIG. 2, the plurality of nozzle rows 19*k*, 19*c*, 19*m*, 19*y*, and 19*oc* included in the recording head 17 are aligned along the direction D1. In addition, the plurality of nozzle rows 19*k*, 19*c*, 19*m*, 19*y*, and 19*oc* are formed at an identical position in the direction D2. The recording device 10 realizes recording on the recording medium 30, by alternately repeating transport of the recording medium 30 by the transport unit 15 in a predetermined "feed amount", and ink discharge by the recording head 17 along with the movement of the carriage 16.

The K ink is ink representing black by only one color, or by a single color. Also, the C, M, and Y inks represent black by being mixed together. Accordingly, each of the nozzle rows 19*k*, 19*c*, 19*m*, and 19*y* corresponds to a "first nozzle row" in which first nozzles that can discharge a first ink representing black by a single color or a mixed color are arranged. Each of the C, M, Y, and K inks corresponds to the "first ink", and each of the nozzles 18 constituting the nozzle rows 19*k*, 19*c*, 19*m*, and 19*y* corresponds to the "first nozzle".

The OC ink corresponds to a "second ink" of the present exemplary embodiment, and is superimposed and recorded on the first ink in order to increase black concentration of a recording result on the recording medium 30. "Increase black concentration" is to make black appear darker by reducing glossiness of black. The OC ink has less pigment concentration than that of the K ink, that is, the OC ink is brighter than the K ink, and is an achromatic ink. For example, a transparent ink called a clear ink or the like, a so-called light gray (LLK) ink, or the like corresponds to the OC ink. In the present exemplary embodiment, a transparent color is also treated as one of the achromatic colors. The nozzle row 19*oc* corresponds to a "second nozzle row" in which second nozzles that can discharge the second ink are arranged, and each of the nozzles 18 constituting the nozzle row 19*oc* corresponds to a "second nozzle".

In an example in FIG. 2, for any of the nozzle rows 19*k*, 19*c*, 19*m*, 19*y*, and 19*oc*, a direction in which the plurality of nozzles 18 constituting the nozzle row are aligned (a nozzle row direction) is parallel with the direction D2. However, as described above, it is sufficient that the nozzle row has a constant nozzle pitch, so the nozzle row direction may be inclined with respect to the direction D2.

The configuration described above may be realized not only by an independent single device, but also may be realized by an information processing device and a printer that are communicatively coupled to each other. The information processing device is, for example, a personal computer (PC), a smart phone, a tablet terminal, a mobile phone, a server, or a device having a similar degree of processing capability as the aforementioned devices. In other words, the recording device 10 may be realized by an information processing device as a recording control device including the control unit 11 and the like, and a printer including the transport unit 15, the carriage 16, the recording head 17, and the like.

Figure 3:
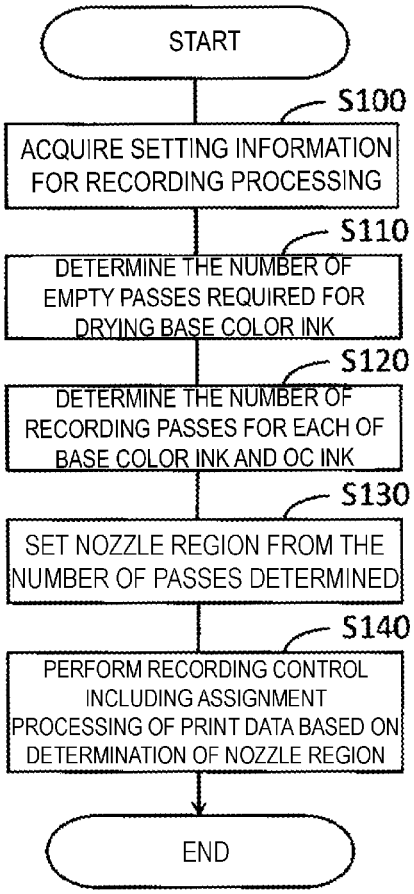
FIG. 3 is a flowchart illustrating recording processing for increasing black concentration.

2. Recording Processing for Increasing Black Concentration:

FIG. 3 illustrates, by a flowchart, recording processing for increasing the black concentration performed by the control unit 11 in accordance with the firmware 12. The control unit 11 has a plurality of recording modes for the recording processing, and when selecting a black concentration increase mode from among the plurality of recording modes, performs the recording processing in FIG. 3. The black concentration increase mode is also referred to as a "first mode". A recording mode other than the black concentration increase mode is referred to as a "second mode". The user may, for example, instruct the control unit 11 which recording mode to select from among the plurality of recording modes, by manipulating the operation accepting unit 14, while visually recognizing a user interface (UI) screen displayed on the display unit 13. The control unit 11 selects the black concentration increase mode in accordance with an instruction by the user.

In step S100, the control unit 11 acquires setting information related to the recording processing. A setting for the recording processing is, for example, a setting for a type of the recording medium 30 used in the recording, and recording quality. The user, for example, operates the operation accepting unit 14 while visually recognizing the UI screen to perform such various settings. The control unit 11 acquires contents of the setting by the user, as the setting information.

In step S110, the control unit 11 determines the number of empty passes required for drying the base color ink, in accordance with the setting information acquired in step S100. The "base color ink" is the first ink. According to the recording processing for increasing the black concentration, the first ink is recorded on the recording medium 30, and the second ink is recorded thereon. Thus, the first ink is referred to as the base color ink in that a base ink for the second ink. An "empty pass" is a pass without ink discharge. A pass with ink discharge is referred to as a "recording pass".

However, the recording pass and the empty pass can be achieved simultaneously in a single pass of the carriage 16. That is, by discharging ink from some of the nozzles 18 of a nozzle row, and not discharging ink from another some of the nozzles 18 of the nozzle row, a recording pass is performed for a certain region in the recording medium 30, and simultaneously, an empty pass is performed for another region in the recording medium 30.

According to the recording processing for increasing the black concentration, the control unit 11 records the base color ink on the recording medium 30 by a recording pass, and then performs one or more times of empty passes before recording the OC ink by another recording pass on a region where the base color ink is recorded. A time spent by the empty pass is a drying time of the base color ink recorded on the recording medium 30. Assuming that a movement distance and a movement speed of one pass by the carriage 16 are predetermined, the drying time of the base color ink is proportional to the number of empty passes.

The control unit 11, for example, determines the number of empty passes in accordance with a type of the recording medium 30 defined in the setting information. In this case, the control unit 11 determines whether the recording medium 30 defined in the setting information is a first type of medium, or a second type of medium requiring more time to fix or penetrate ink than that for the first type. For example, a certain type of paper corresponds to the first type of medium, and a transparent film corresponds to the second type of medium. Then, when the recording medium 30 defined in the setting information is the first type of medium, the control unit 11 determines the number of empty passes that is less than the number of empty passes determined when the recording medium 30 defined in the setting information is the second type of medium.

In step S120, the control unit 11 determines the number of recording passes for the base color ink, and the number of recording passes for the OC ink, in accordance with the setting information acquired in step S100. In this case, in accordance with recording quality defined in the setting information, the control unit 11 determines the number of recording passes for the base color ink and the number of recording passes for the OC ink as an identical number, or determines the number of recording passes for the OC ink to be less than the number of recording passes for the base color ink. The user may set the recording quality via the UI screen, for example, from among a plurality of options, such as "fine", "normal", "fast", and the like. "Fast" is a setting in which a print speed is emphasized, and means low recording quality. For example, when the recording quality defined in the setting information is "fine", the control unit 11 determines the number of recording passes for the base color ink to be a predetermined number, and determines the number of recording passes for the OC ink to be the predetermined number as well. On the other hand, when the recording quality defined in the setting information is "normal" or "fast", the control unit 11 determines the number of recording passes for the base color ink to be the predetermined number, and determines the number of recording passes for the OC ink to be a number less than the predetermined number.

The control unit 11 may perform the processes in steps S110 and S120 in a reverse order of an order illustrated in FIG. 3, or may perform the processes in parallel.

In step S130, the control unit 11 provides a nozzle region for a nozzle row, from the number of empty passes and the number of recording passes determined in steps S110 and S120. The nozzle region provided in step S130 includes, a "first nozzle used region 40" by the first nozzle discharging the base color ink, a "second nozzle used region 41" by the second nozzle discharging the OC ink onto a region of the recording medium 30 onto which the base color ink is discharged, and a "nozzle unused region 42" by the first nozzle not discharging the base color ink and the second nozzle not discharging the OC color ink, between the first nozzle used region 40 and the second nozzle used region 41.

Each of FIGS. 4, 5, 6, 7, 8, and 9 illustrates a setting example of the nozzle region in step S130. Since a way of viewing each of FIGS. 4 to 9 is similar, a description common to that in FIG. 4 will be omitted as appropriate for FIGS. 5 to 9.

Figure 4:
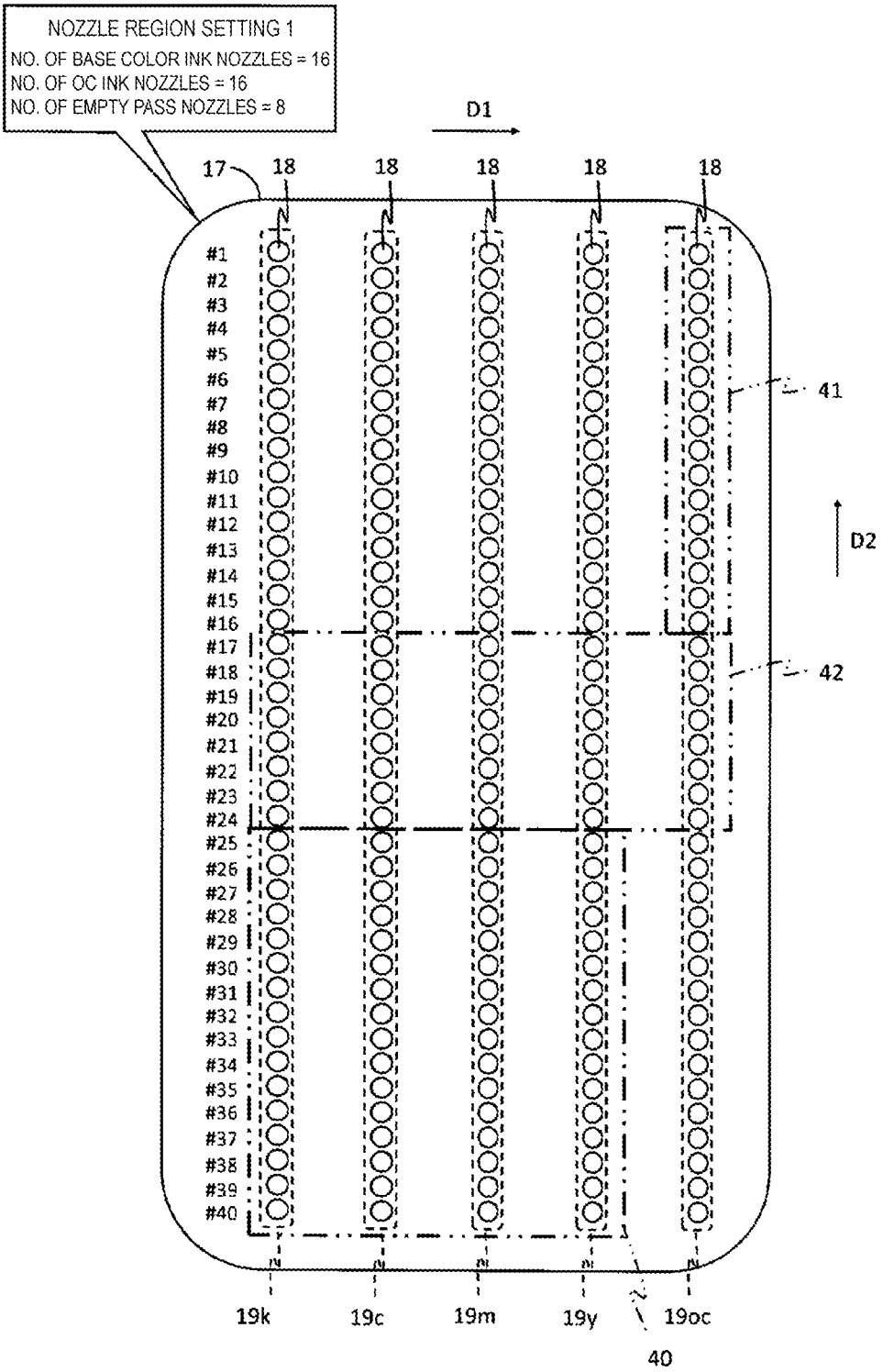
FIG. 4 is a diagram for describing a nozzle region setting 1 in the nozzle rows.

FIG. 4 illustrates the nozzle rows 19*k*, 19*c*, 19*m*, 19*y*, and 19*oc* included in the recording head 17. In FIG. 4, similar to FIG. 2, a corresponding relationship among the recording head 17, the directions D1, and D2 is also illustrated. In FIG. 4, as an example, each of the nozzle rows 19*k*, 19*c*, 19*m*, 19*y*, and 19*oc* is constituted by 40 number of the nozzles 18. For convenience of explanation in FIG. 4, the nozzles 18 are assigned respective nozzle numbers #1 to #40, from downstream to upstream in the transport direction D2. Because the nozzle rows 19*k*, 19*c*, 19*m*, 19*y*, and 19*oc* are formed at an identical position in the direction D2, the nozzle number is information common to each of the nozzle rows 19*k*, 19*c*, 19*m*, 19*y*, and 19*oc*. That is, the respective nozzles 18 belonging to different nozzle rows and having a common nozzle number have an identical position in the direction D2.

FIG. 4 is a setting example of a nozzle region when the number of empty passes=2, the number of recording passes for the base color ink=4, and the number of recording passes for the OC ink=4 are determined, in steps S110 and S120. The setting example in FIG. 4 is referred to as a "nozzle region setting 1". In this case, the number of nozzles of "4" obtained by dividing the number of nozzles (40) in the nozzle row by the number of passes (10 times), corresponds to one feed amount by the transport unit 15, in order to perform 10 passes in total including recording passes and empty passes for a unit region in the recording medium 30. In other words, the control unit 11 determines nozzle pitch×4 as the feed amount, so as to correspond to the nozzle region setting 1.

Accordingly, in the nozzle region setting 1, the number of nozzles of "16" obtained by multiplying the number of nozzles corresponding to the feed amount by the number of recording passes for the base color ink, is the number of nozzles in the transport direction D2 used for recording the base color ink. Additionally, in the nozzle region setting 1, the number of nozzles of "8" obtained by multiplying the number of nozzles corresponding to the feed amount by the number of empty passes, is the number of empty pass nozzles in the transport direction D2. Additionally, in the nozzle region setting 1, the number of nozzles of "16" obtained by multiplying the number of nozzles corresponding to the feed amount by the number of recording passes for the OC ink, is the number of nozzles in the transport direction D2 used for recording the OC ink.

In order to ensure each of the number of nozzles used for recording the base color ink, the number of empty pass nozzles, and the number of nozzles used for recording the OC ink, in the nozzle row as described above, the control unit 11 provides the first nozzle used region 40, the second nozzle used region 41, and the nozzle unused region 42, as illustrated in FIG. 4. In other words, in the nozzle region setting 1, a region of each of the nozzle rows 19*k*, 19*c*, 19*m*, and 19*y* having the respective nozzles 18 having the nozzle numbers #25 to #40 is the first nozzle used region 40. In addition, in the nozzle region setting 1, a region of the nozzle row 19*oc* having the respective nozzles 18 having the nozzle numbers #1 to #16 is the second nozzle used region 41. In the nozzle region setting 1, a region of each of the nozzle rows 19*k*, 19*c*, 19*m*, 19*y*, and 19*oc* having the respective nozzles 18 having the nozzle numbers #17 to #24 between the first nozzle used region 40 and the second nozzle used region 41 is the nozzle unused region 42.

The nozzle 18 that do not belong to any of the nozzle unused region 42, the first nozzle used region 40, and the second nozzle used region 41 is also not used for recording, similar to the nozzles 18 in the nozzle unused region 42.

However, the nozzle 18 that do not belong to any of the nozzle unused region 42, the first nozzle used region 40, and the second nozzle used region 41 does not satisfy a condition of being between the first nozzle used region 40 and the second nozzle used region 41 in the direction D2, and thus does not correspond to the nozzle unused region 42 in the present exemplary embodiment.

Figure 5:
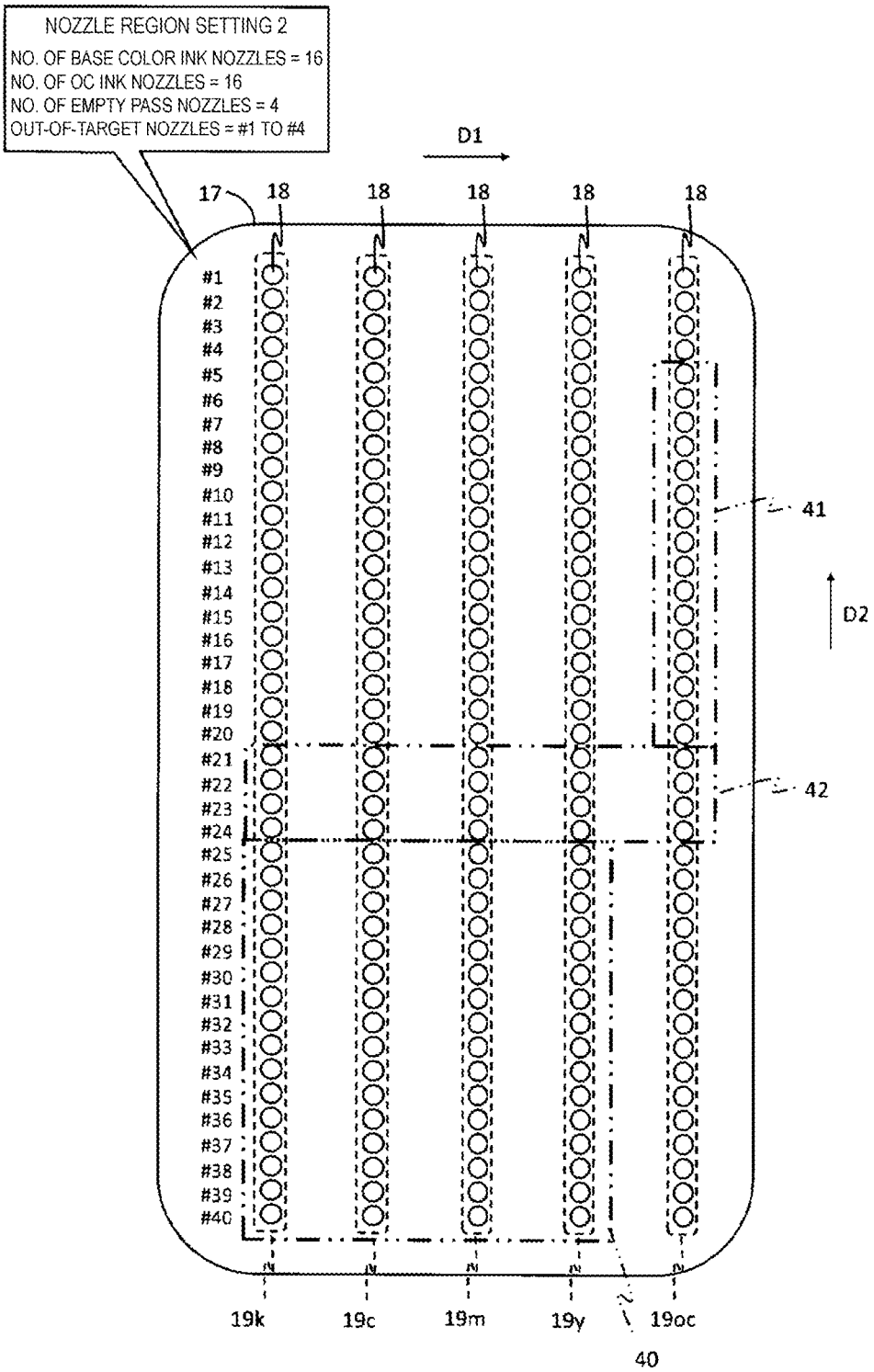
FIG. 5 is a diagram for describing a nozzle region setting 2 in the nozzle rows.

FIG. 5 is a setting example of a nozzle region when the number of empty passes=1, the number of recording passes for the base color ink=4, and the number of recording passes for the OC ink=4 are determined, in steps S110 and S120. The setting example in FIG. 5 is referred to as a "nozzle region setting 2". The control unit 11 determines nozzle pitch×4 as the feed amount, so as to correspond to the nozzle region setting 2, similar to the nozzle region setting 1 in FIG. 4. Accordingly, in the nozzle region setting 2, the number of nozzles of "16" obtained by multiplying the number of nozzles corresponding to the feed amount by the number of recording passes for the base color ink, is the number of nozzles in the transport direction D2 used for recording the base color ink. Additionally, in the nozzle region setting 2, the number of nozzles of "4" obtained by multiplying the number of nozzles corresponding to the feed amount by the number of empty passes, is the number of empty pass nozzles in the transport direction D2. Additionally, in the nozzle region setting 2, the number of nozzles of "16" obtained by multiplying the number of nozzles corresponding to the feed amount by the number of recording passes for the OC ink, is the number of nozzles in the transport direction D2 used for recording the OC ink.

In order to ensure each of the number of nozzles used for recording the base color ink, the number of empty pass nozzles, and the number of nozzles used for recording the OC ink, in the nozzle row, the control unit 11 provides the first nozzle used region 40, the second nozzle used region 41, and the nozzle unused region 42, as illustrated in FIG. 5. In other words, in the nozzle region setting 2, a region of each of the nozzle rows 19*k*, 19*c*, 19*m*, and 19*y* having the respective nozzles 18 having the nozzle numbers #25 to #40 is the first nozzle used region 40. In addition, in the nozzle region setting 2, a region of the nozzle row 19*oc* having the respective nozzles 18 having the nozzle numbers #5 to #20 is the second nozzle used region 41. In the nozzle region setting 2, a region of each of the nozzle rows 19*k*, 19*c*, 19*m*, 19*y*, and 19*oc* having the respective nozzles 18 having the nozzle numbers #21 to #24 between the first nozzle used region 40 and the second nozzle used region 41 is the nozzle unused region 42.

In the nozzle region setting 2, the number of nozzles in the nozzle unused region 42 is half as compared to that in the nozzle region setting 1. Thus, the respective nozzles 18 having the nozzle numbers #1 to #4 downstream the second nozzle used region 41 in the transport direction D2 are not used for recording on the recording medium 30. The nozzle 18 that does not overlap with any of the first nozzle used region 40, the second nozzle used region 41, and the nozzle unused region 42, in the transport direction D2, such as the respective nozzles 18 having the nozzle numbers #1 to #4 in FIG. 5, is referred to as an out-of-target nozzle.

Figure 6:
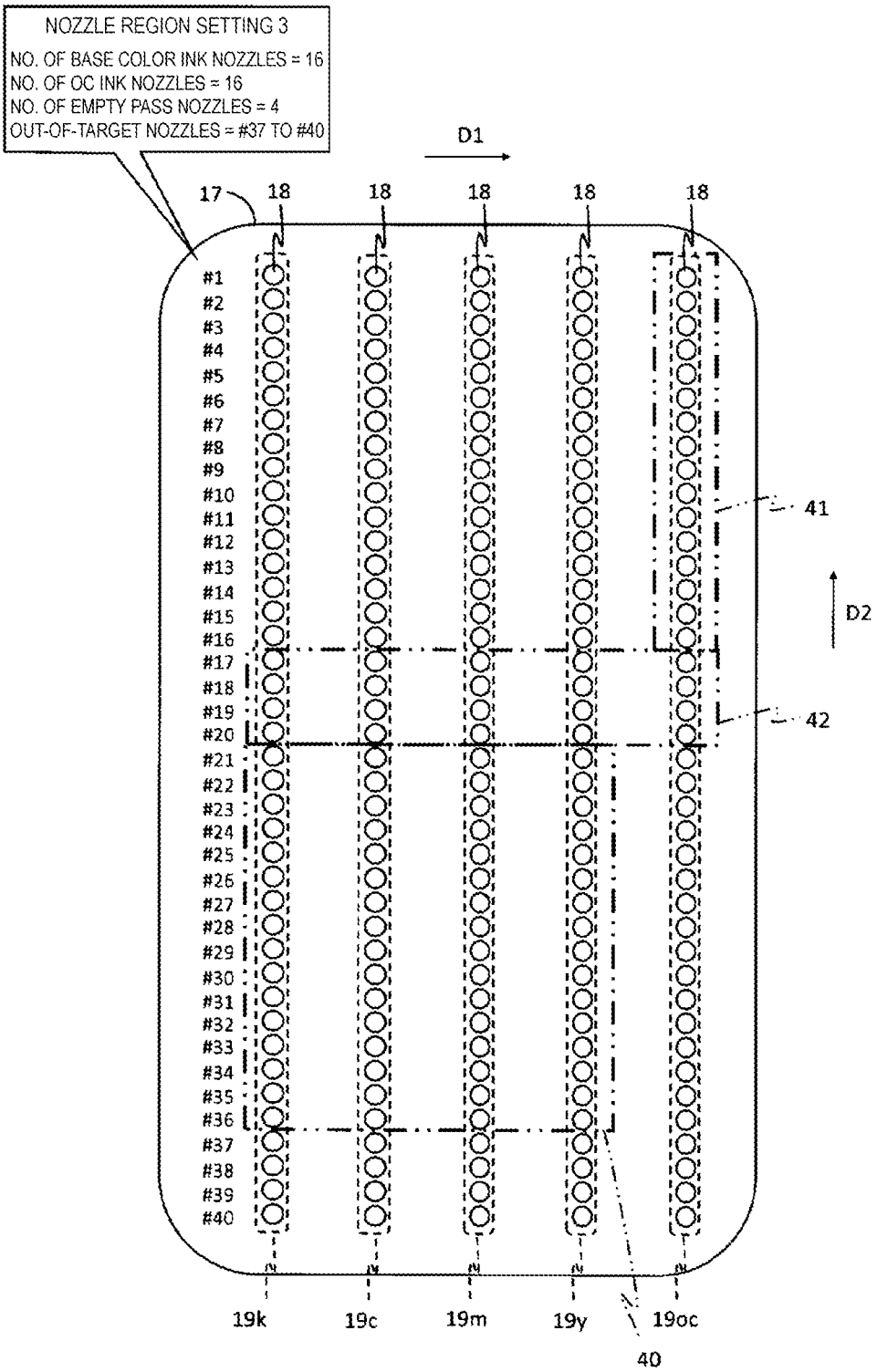
FIG. 6 is a diagram for describing a nozzle region setting 3 in the nozzle rows.

FIG. 6 is a setting example of a nozzle region when the number of empty passes=1, the number of recording passes for the base color ink=4, and the number of recording passes for the OC ink=4 are determined, in steps S110 and S120. The setting example in FIG. 6 is referred to as a "nozzle region setting 3". The nozzle region setting 3 differs in positions of out-of-target nozzles, when compared to the nozzle region setting 2 in FIG. 5. In the nozzle region setting 3, the respective nozzles 18 having the nozzle numbers #37 to #40 upstream in the transport direction D2 are the out-of-target nozzles, and the first nozzle used region 40, the second nozzle used region 41, and the nozzle unused region 42 are provided downstream the out-of-target nozzles. In other words, in the nozzle region setting 3, a region of each of the nozzle rows 19*k*, 19*c*, 19*m*, and 19*y* having the respective nozzles 18 having the nozzle numbers #21 to #36 is the first nozzle used region 40, and a region of the nozzle row 19*oc* having the respective nozzles 18 having the nozzle numbers #1 to #16 is the second nozzle used region 41, and a region of each of the nozzle rows 19*k*, 19*c*, 19*m*, 19*y*, and 19*oc* having the respective nozzles 18 having the nozzle numbers #17 to #20, between the first nozzle used region 40 and the second nozzle used region 41 is the nozzle unused region 42.

Figure 7:
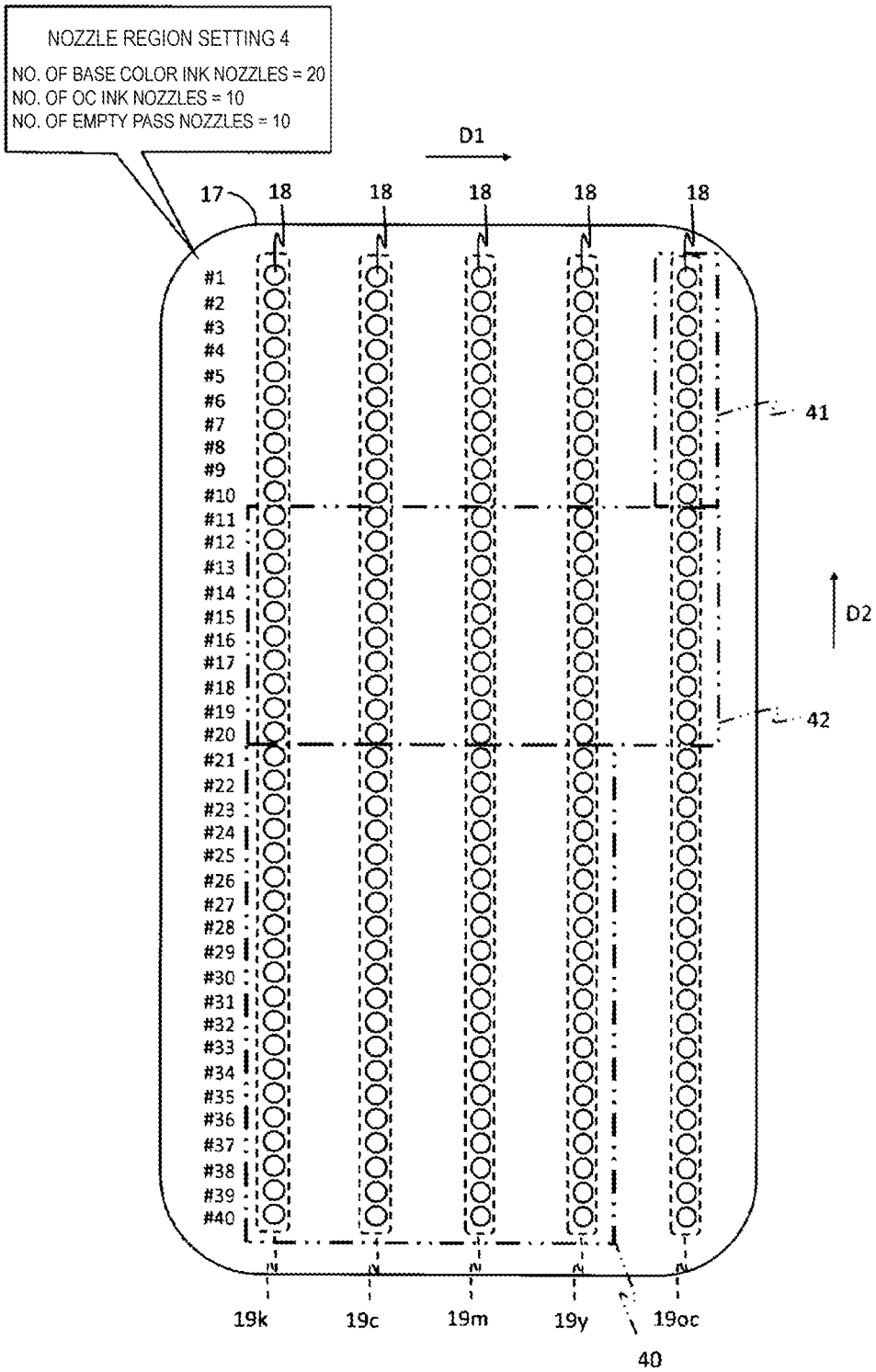
FIG. 7 is a diagram for describing a nozzle region setting 4 in the nozzle rows.

FIG. 7 is a setting example of a nozzle region when the number of empty passes=2, the number of recording passes for the base color ink=4, and the number of recording passes for the OC ink=2 are determined, in steps S110 and S120. The setting example in FIG. 7 is referred to as a "nozzle region setting 4". In this case, the number of nozzles of "5" obtained by dividing the number of nozzles (40) in the nozzle row by the number of passes (8 times), corresponds to a feed amount, in order to perform 8 passes in total including recording passes and empty passes for a unit region in the recording medium 30.

In other words, the control unit 11 determines nozzle pitch×5 as the feed amount, so as to correspond to the nozzle region setting 4.

Accordingly, in the nozzle region setting 4, the number of nozzles of "20" obtained by multiplying the number of nozzles corresponding to the feed amount by the number of recording passes for the base color ink, is the number of nozzles in the transport direction D2 used for recording the base color ink. Additionally, in the nozzle region setting 4, the number of nozzles of "10" obtained by multiplying the number of nozzles corresponding to the feed amount by the number of empty passes, is the number of empty pass nozzles in the transport direction D2. Additionally, in the nozzle region setting 4, the number of nozzles of "10" obtained by multiplying the number of nozzles corresponding to the feed amount by the number of recording passes for the OC ink, is the number of nozzles in the transport direction D2 used for recording the OC ink.

In order to ensure each of the number of nozzles used for recording the base color ink, the number of empty pass nozzles, and the number of nozzles used for recording the OC ink, in the nozzle row, the control unit 11 provides the first nozzle used region 40, the second nozzle used region 41, and the nozzle unused region 42, as illustrated in FIG. 7. In other words, in the nozzle region setting 4, a region of each of the nozzle rows 19*k*, 19*c*, 19*m*, and 19*y* having the respective nozzles 18 having the nozzle numbers #21 to #40 is the first nozzle used region 40. In addition, in the nozzle region setting 4, a region of the nozzle row 19*oc* having the respective nozzles 18 having the nozzle numbers #1 to #10 is the second nozzle used region 41. In the nozzle region setting 4, a region of each of the nozzle rows 19*k*, 19*c*, 19*m*, 19*y*, and 19*oc* having the respective nozzles 18 having the nozzle numbers #11 to #20, between the first nozzle used region 40 and the second nozzle used region 41 is the nozzle unused region 42.

Figure 8:
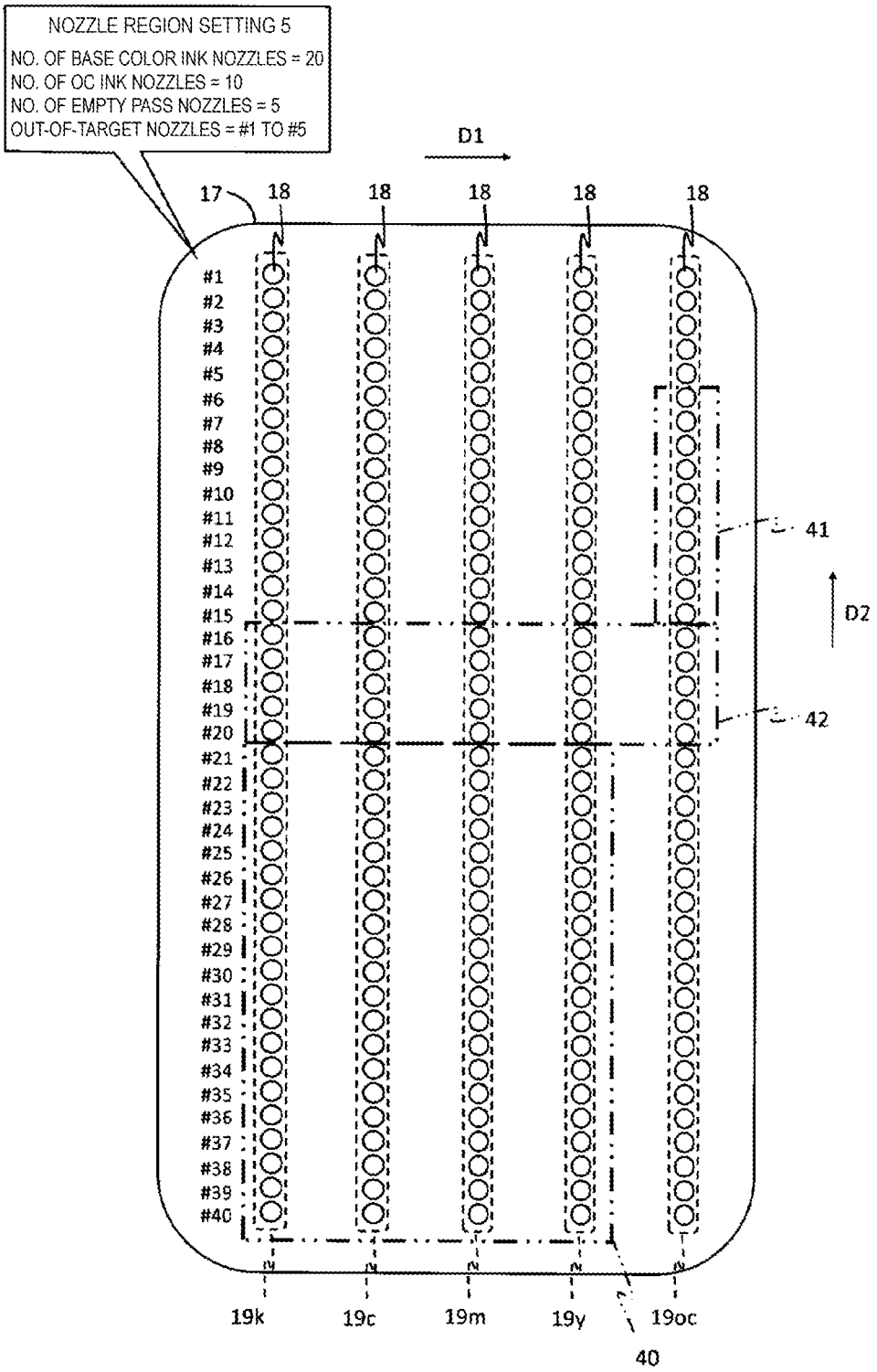
FIG. 8 is a diagram for describing a nozzle region setting 5 in the nozzle rows.

FIG. 8 is a setting example of a nozzle region when the number of empty passes=1, the number of recording passes for the base color ink=4, and the number of recording passes for the OC ink=2 are determined, in steps S110 and S120. The setting example in FIG. 8 is referred to as a "nozzle region setting 5". The control unit 11 determines nozzle pitch×5 as the feed amount, so as to correspond to the nozzle region setting 5, similar to the nozzle region setting 4 in FIG. 7. Accordingly, in the nozzle region setting 5, the number of nozzles of "20" obtained by multiplying the number of nozzles corresponding to the feed amount by the number of recording passes for the base color ink, is the number of nozzles in the transport direction D2 used for recording the base color ink. Additionally, in the nozzle region setting 5, the number of nozzles of "5" obtained by multiplying the number of nozzles corresponding to the feed amount by the number of empty passes, is the number of empty pass nozzles in the transport direction D2. Additionally, in the nozzle region setting 2, the number of nozzles of "10" obtained by multiplying the number of nozzles corresponding to the feed amount by the number of recording passes for the OC ink, is the number of nozzles in the transport direction D2 used for recording the OC ink.

In order to ensure each of the number of nozzles used for recording the base color ink, the number of empty pass nozzles, and the number of nozzles used for recording the OC ink, in the nozzle row, the control unit 11 provides the first nozzle used region 40, the second nozzle used region 41, and the nozzle unused region 42, as illustrated in FIG. 8. In other words, in the nozzle region setting 5, a region of each of the nozzle rows 19*k*, 19*c*, 19*m*, and 19*y* having the respective nozzles 18 having the nozzle numbers #21 to #40 is the first nozzle used region 40. In addition, in the nozzle region setting 5, a region of the nozzle row 19*oc* having the respective nozzles 18 having the nozzle numbers #6 to #15 is the second nozzle used region 41. In the nozzle region setting 5, a region of each of the nozzle rows 19*k*, 19*c*, 19*m*, 19*y*, and 19*oc* having the respective nozzles 18 having the nozzle numbers #16 to #20, between the first nozzle used region 40 and the second nozzle used region 41 is the nozzle unused region 42. In the nozzle region setting 5, the number of nozzles in the nozzle unused region 42 is half as compared to that in the nozzle region setting 4. Thus, the respective nozzles 18 having the nozzle numbers #1 to #5 downstream the second nozzle used region 41 in the transport direction D2 are out-of-target nozzles.

Figure 9:
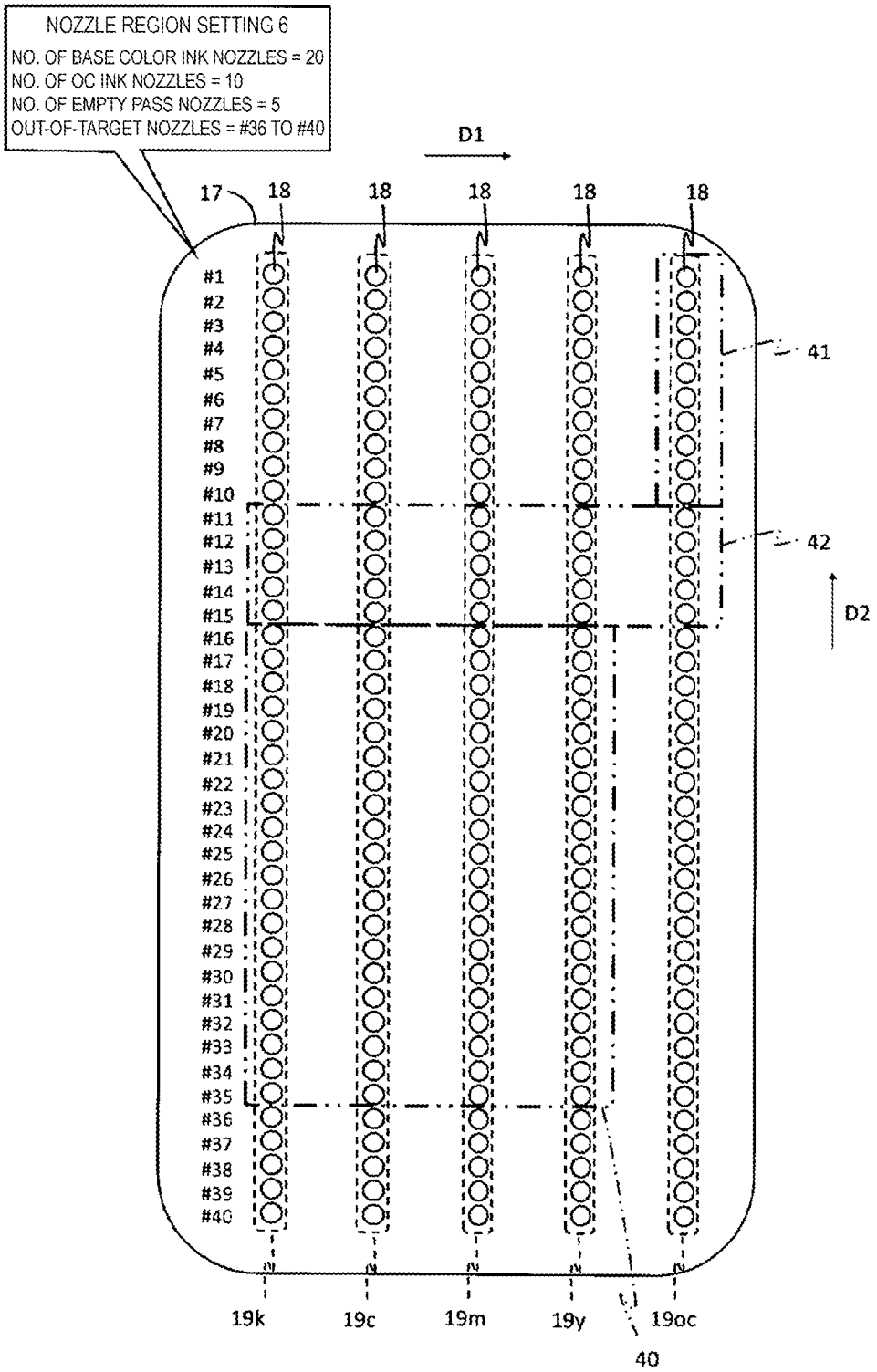
FIG. 9 is a diagram for describing a nozzle region setting 6 in the nozzle rows.

FIG. 9 is a setting example of a nozzle region when the number of empty passes=1, the number of recording passes for the base color ink=4, and the number of recording passes for the OC ink=2 are determined, in steps S110 and S120. The setting example in FIG. 9 is referred to as a "nozzle region setting 6". The nozzle region setting 6 differs in positions of out-of-target nozzles, when compared to the nozzle region setting 5 in FIG. 8. In the nozzle region setting 6, the respective nozzles 18 having the nozzle numbers #36 to #40 upstream in the transport direction D2 are the out-of-target nozzles, and the first nozzle used region 40, the second nozzle used region 41, and the nozzle unused region 42 are provided downstream the out-of-target nozzles. In other words, in the nozzle region setting 6, a region of each of the nozzle rows 19*k*, 19*c*, 19*m*, and 19*y* having the respective nozzles 18 having the nozzle numbers #16 to #35 is the first nozzle used region 40, and a region of the nozzle row 19*oc* having the respective nozzles 18 having the nozzle numbers #1 to #10 is the second nozzle used region 41, and a region of each of the nozzle rows 19*k*, 19*c*, 19*m*, 19*y*, and 19*oc* having the respective nozzles 18 having the nozzle numbers #11 to #15, between the first nozzle used region 40 and the second nozzle used region 41 is the nozzle unused region 42.

When the recording medium 30 defined in the setting information is the second type of medium, and the recording quality defined in the setting information is "fine", the control unit 11 may employ the nozzle region setting 1 in step S130.

In addition, when the recording medium 30 is the first type of medium, and the recording quality is "fine", the control unit 11 may employ either the nozzle region setting 2 or the nozzle region setting 3 in Step S130.

When the recording medium 30 is the second type of medium and the recording quality is "normal" or "fast", the control unit 11 may employ the nozzle region setting 4 in step S130.

When the recording medium 30 is the first type of medium and the recording quality is "normal" or "fast", the control unit 11 may employ either the nozzle region setting 5 or the nozzle region setting 6 in step S130.

It is also possible that the nozzle region setting 2 and the nozzle region setting 3 are such settings that only one of the settings may be employed by the control unit 11. Similarly, it is also possible that the nozzle region setting 5 and the nozzle region setting 6 are such settings that only one of the settings may be employed by the control unit 11.

In step S140, the control unit 11 performs recording control including a process of assigning print data based on the setting for the nozzle region in step S130. The recording control in step S140 is control over the carriage 16, the recording head 17, and the transport unit 15 by the control unit 11.

The print data is image data representing an image to be a recording target. The recording target is any object such as a letter, CG, or a photograph. More specifically, the print data is bit map data defining discharge (dot-on) or non-discharge (dot-off) of a dot for each ink type such as C, M, Y, K, or OC for each pixel. The control unit 11, for example, acquires print data from a memory in and out of the recording device 10 accessible by the recording device 10, a PC outside the recording device 10 accessible by the recording device 10, and the like. Alternatively, the control unit 11 may generate print data to acquire the print data. In other words, the control unit 11 acquires image data representing the object in multiple tones (for example, 256 tones) with RGB (red, green, blue), or CMYK, and generates bit map data defining dot-on or dot-off for each of the C, M, Y, and K inks for each pixel, for such image data, by performing known processing such as color conversion processing and halftone processing. A combination of the bit map data generated in this manner and, for example, separately generated bit map data defining dot-on or dot-off for the OC ink for each pixel is referred to as print data.

Figure 10:
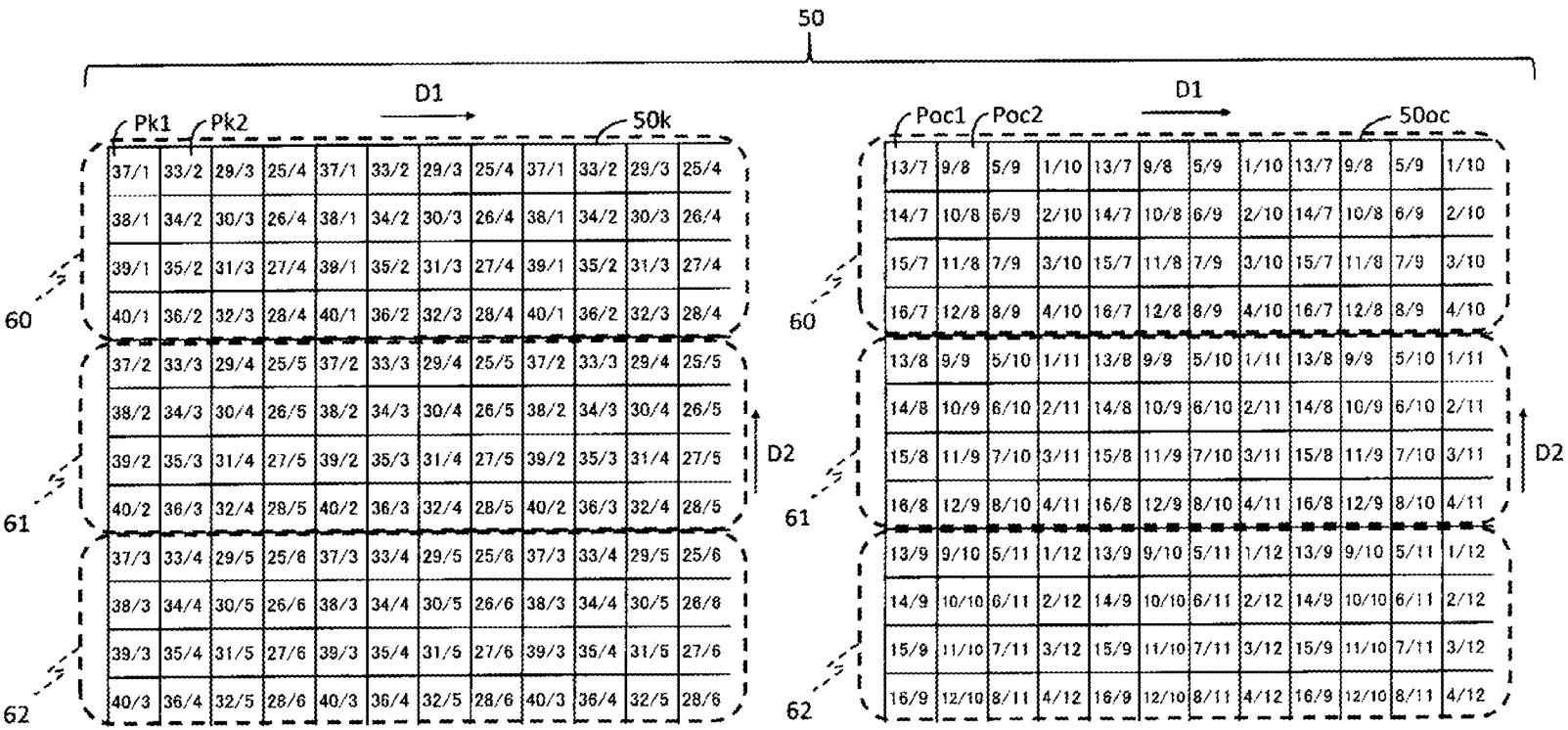
FIG. 10 is a diagram for describing a relationship among pixels, passes as assignment destinations, and nozzles corresponding to the nozzle region setting 1.

FIG. 10 is a diagram illustrating a corresponding relationship among pixels constituting print data 50, passes as assignment destinations, and the nozzles 18. FIG. 10 illustrates the corresponding relationship when the control unit 11 employs the nozzle region setting 1 in FIG. 4, as a setting for a nozzle region. A reference numeral 50*k* denotes part of print data for the K ink defining dot-on or dot-off of the K ink for each pixel, of the print data 50. In addition, a reference numeral 50*oc* denotes part of print data for the OC ink defining dot-on or dot-off of the OC ink for each pixel, of the print data 50. Needless to say, the print data 50*k* is assigned to each of the nozzles 18 in the nozzle row 19*k*, and the print data 50*oc* is assigned to each of the nozzles 18 in the nozzle row 19*oc*. Each rectangle constituting the print data 50*k* and 50*oc* represents each pixel. In FIG. 10, a corresponding relationship among the print data 50*k*, 50*oc*, the directions D1, and D2 is also illustrated.

The print data 50*k* and the print data 50*oc* are data for an identical position. In other words, respective positions of a pixels Pk1 of the print data 50*k* and a pixel Poc1 of the print data 50*oc* coincide. Similarly, respective positions of a pixels Pk2 of the print data 50*k* and a pixel Poc2 of the print data 50*oc* coincide. Numbers described in a rectangle representing a pixel mean "nozzle number as assignment destination/pass number of assignment destination". When an initial pass for recording the printed data 50 on the recording medium 30 is referred to as a "first pass" (hereinafter similar), for example, the pixel Pk1 of the print data 50*k* for which "37/1" is described is assigned to the nozzle 18 having the nozzle number #37 in the nozzle row 19*k* for the first pass. Also, for example, the pixel Pod of print data 50*oc* for which "13/7" is described is assigned to the nozzle 18 having the nozzle number #13 in the nozzle row 19*oc* for a seventh pass.

A reference numeral 60 denotes unit region data 60 representing an image to be recorded on a unit region in the recording medium 30. The unit region data 60 of the printed data 50*k* and the unit region data 60 of the print data 50*oc* are overlapping and coincident regions, and thus are substantially an identical region. Symbols 61 and 62 also denote different unit region data, respectively. One piece of unit region data is a region in which an identical number of raster lines to the number of nozzles corresponding to a feed amount are arranged continuously along the direction D2. A raster line is a region in which pixels are continuously arranged in the direction D1, and is also referred to as a pixel row. In the nozzle region settings 1 to 3, a feed amount corresponds to four nozzles, so the unit region data 60, 61, and 62 illustrated in FIG. 10 are each constituted by four raster lines. Such unit region data is sorted into a plurality of passes, so that recording on a unit region in the recording medium 30 completes in the plurality of passes.

According to FIG. 10, pixels constituting the print data 50*k* of the unit region data 60 are assigned to the nozzles 18 in the first nozzle used region 40 (nozzle numbers #25 to #40) in the nozzle region setting 1 (FIG. 4) corresponding to any of first, second, third, and fourth passes of four passes in total. Additionally, pixels constituting the print data 50*oc* of the unit region data 60 are assigned to the nozzles 18 in the second nozzle used region 41 (nozzle numbers #1 to #16) in the nozzle region setting 1 (FIG. 4) corresponding to any of seventh, eighth, ninth, and tenth passes of four passes in total. In FIG. 10, for the unit region data 60, assignment to the nozzles 18 is not performed in fifth and sixth passes. In other words, for recording of the unit region data 60 on the recording medium 30, the fifth and sixth passes are empty passes.

Similarly, according to FIG. 10, pixels constituting the print data 50*k* of the unit region data 61 are assigned to the nozzles 18 in the first nozzle used region 40 (nozzle numbers #25 to #40) in the nozzle region setting 1 (FIG. 4) corresponding to any of second, third, fourth, and fifth passes of four passes in total. Additionally, pixels constituting the print data 50*oc* of the unit region data 61 are assigned to the nozzles 18 in the second nozzle used region 41 (nozzle numbers #1 to #16) in the nozzle region setting 1 (FIG. 4) corresponding to any of eighth, ninth, tenth, and eleventh passes of four passes in total. In FIG. 10, for the unit region data 61, assignment to the nozzles 18 is not performed in sixth and seventh passes. In other words, for recording of the unit region data 61 on the recording medium 30, the sixth and seventh passes are empty passes.

Figure 11:
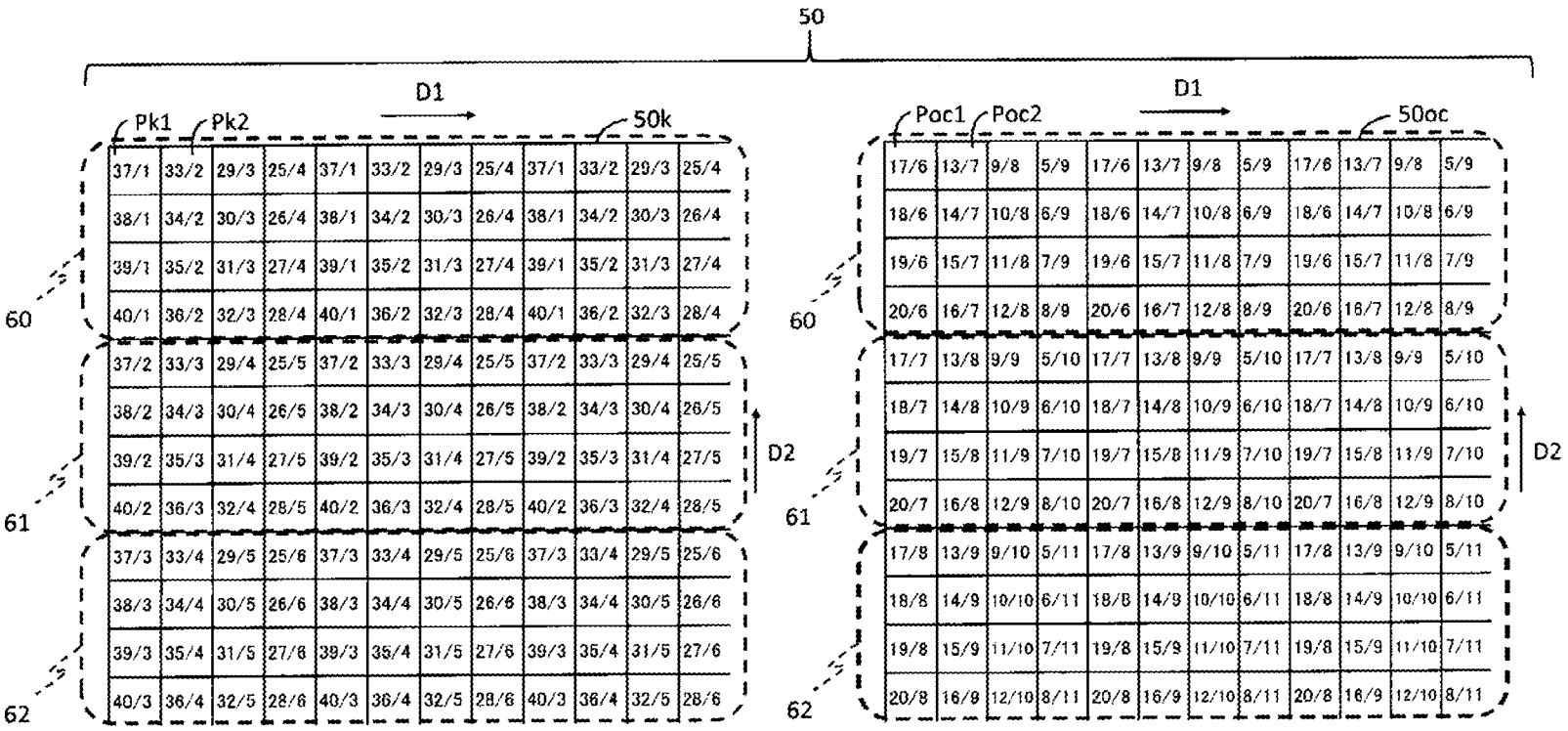
FIG. 11 is a diagram describing a relationship among pixels, passes as assignment destinations, and nozzles corresponding to the nozzle region setting 2.

FIG. 11 is a diagram illustrating a corresponding relationship among the pixels constituting the print data 50, passes as assignment destinations, and the nozzles 18, when the nozzle region setting 2 in FIG. 5 is employed as a setting for a nozzle region. Since a way of viewing each of FIGS. 10 to 13 is similar, a description common to that in FIG. 10 will be omitted as appropriate for FIGS. 11 to 13.

In FIG. 11 and FIG. 10, for the print data 50*k*, assignment of each pixel to a pass and the nozzle 18 is exactly identical. On the other hand, for the print data 50*oc*, according to FIG. 11, pixels constituting the unit region data 60 are assigned to the nozzles 18 in the second nozzle used region 41 (nozzle numbers #5 to #20) in the nozzle region setting 2 (FIG. 5) corresponding to any of sixth, seventh, eighth, and ninth passes of four passes in total. In other words, according to FIG. 11, for recording the unit region data 60 on the recording medium 30, a fifth pass is an empty pass. Similarly, according to FIG. 11, the pixels constituting the print data 50*oc* of the unit region data 61 are assigned to the nozzles 18 in the second nozzle used region 41 (nozzle numbers #5 to #20) in the nozzle region setting 2 (FIG. 5) corresponding to any of seventh, eighth, ninth, and tenth passes of four passes in total. In other words, according to FIG. 11, for recording the unit region data 61 on the recording medium 30, the sixth pass is an empty pass.

Figure 12:
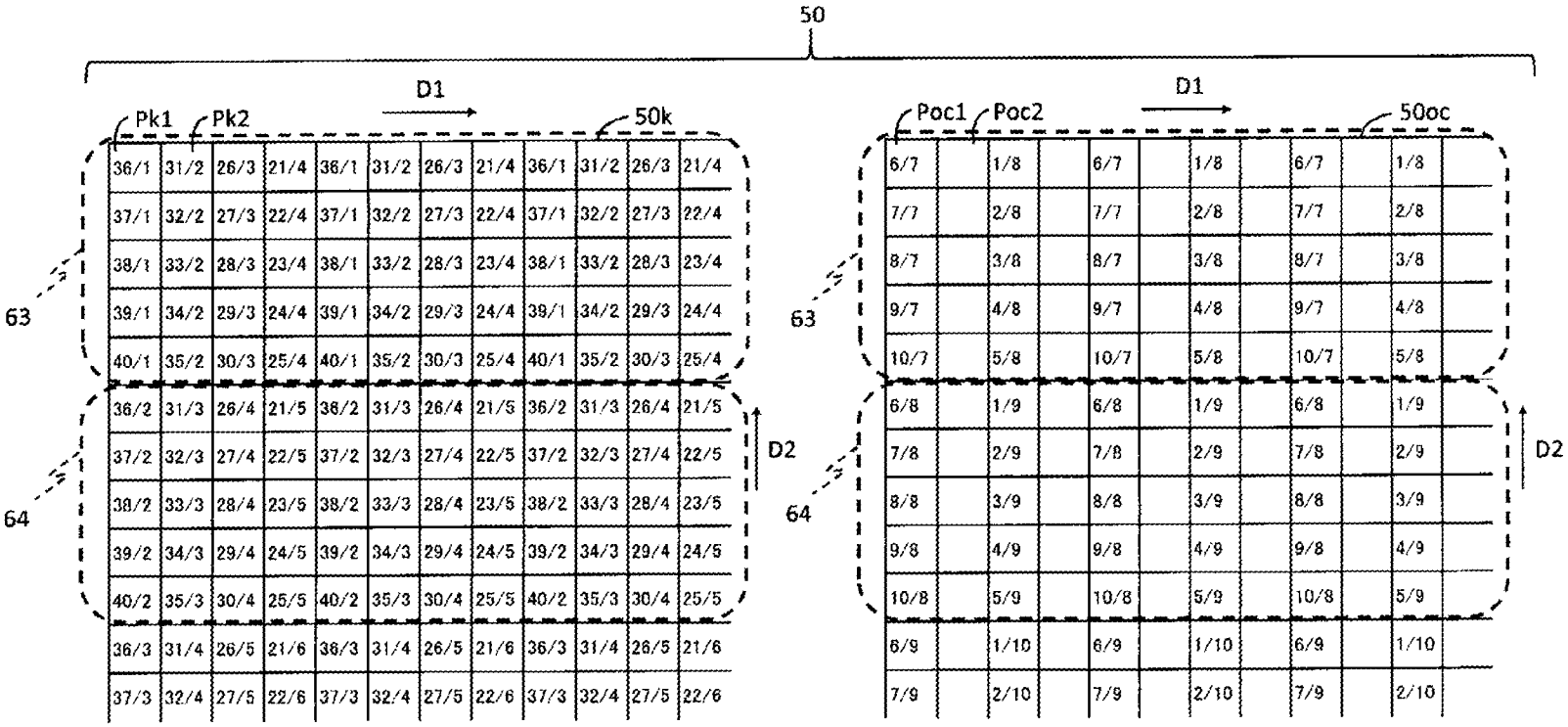
FIG. 12 is a diagram describing a relationship among pixels, passes as assignment destinations, and nozzles corresponding to the nozzle region setting 4.

FIG. 12 is a diagram illustrating a corresponding relationship among the pixels constituting the print data 50, passes as assignment destinations, and the nozzles 18, when the nozzle region setting 4 in FIG. 7 is employed as a setting for a nozzle region. Reference numerals 63 and 64 denote different unit region data, respectively. In the nozzle region settings 4 to 6, a feed amount corresponds to five nozzles, so the unit region data 63 and 64 illustrated in FIG. 12 are each constituted by five raster lines.

According to FIG. 12, pixels constituting the print data 50*k* of the unit region data 63 are assigned to the nozzles 18 in the first nozzle used region 40 (nozzle numbers #21 to #40) in the nozzle region setting 4 (FIG. 7) corresponding to any of first, second, third, and fourth passes of four passes in total. Additionally, pixels constituting the print data 50*oc* of the unit region data 63 are assigned to the nozzles 18 in the second nozzle used region 41 (nozzle numbers #1 to #10) in the nozzle region setting 4 (FIG. 7) corresponding to any of seventh and eighth passes of two passes in total. In other words, according to FIG. 12, for recording of the unit region data 63 on the recording medium 30, the fifth and sixth passes are empty passes. Similarly, according to FIG. 12, pixels constituting the print data 50*k* of the unit region data 64 are assigned to the nozzles 18 in the first nozzle used region 40 (nozzle numbers #21 to #40) in the nozzle region setting 4 (FIG. 7) corresponding to any of second, third, fourth, and fifth passes of four passes in total. Additionally, pixels constituting the print data 50*oc* of the unit region data 64 are assigned to the nozzles 18 in the second nozzle used region 41 (nozzle numbers #1 to #10) in the nozzle region setting 4 (FIG. 7) corresponding to any of eighth and ninth passes of two passes in total. In other words, according to FIG. 12, for recording the unit region data 64 on the recording medium 30, the sixth pass and the seventh pass are empty passes.

Figure 13:
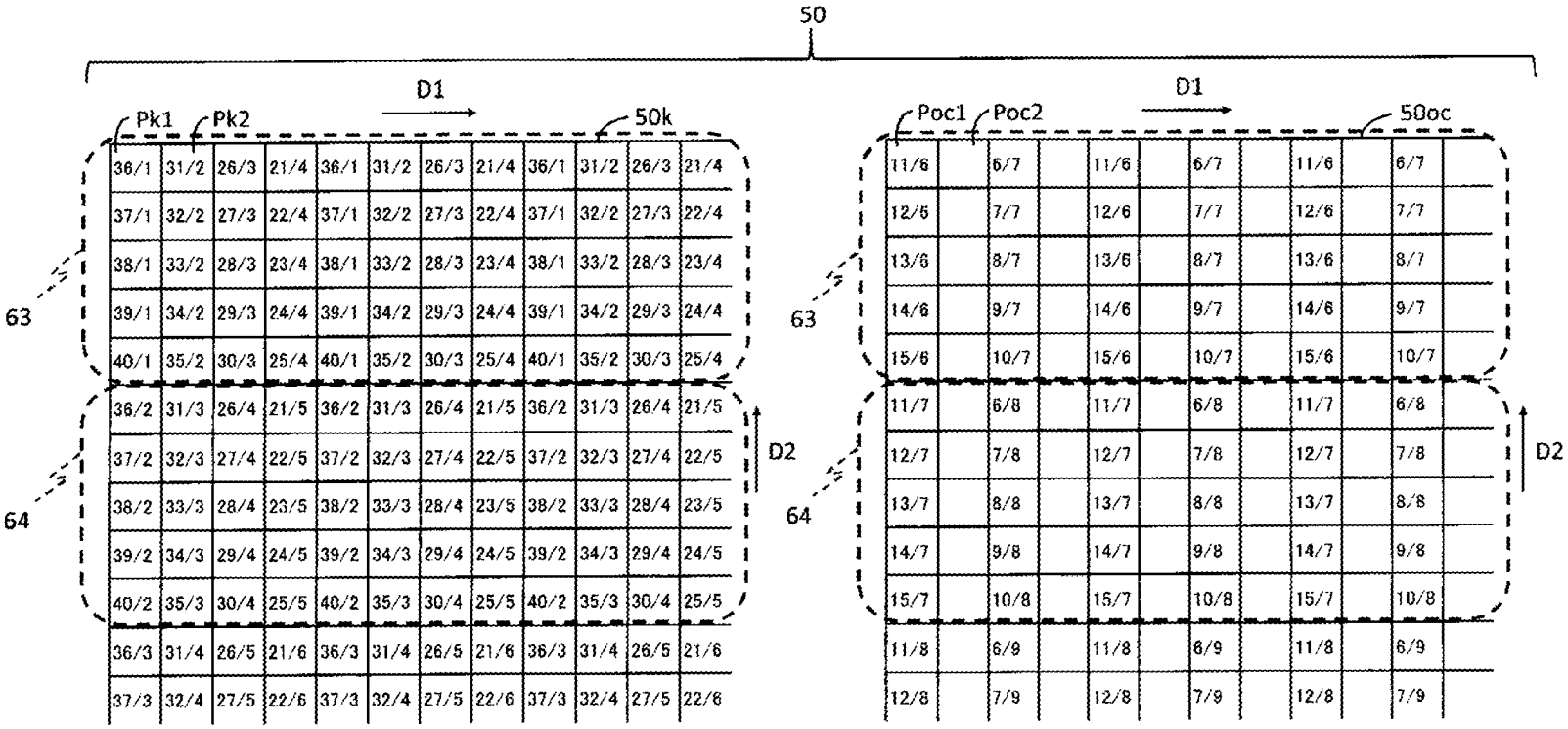
FIG. 13 is a diagram describing a relationship among pixels, passes as assignment destinations, and nozzles corresponding to the nozzle region setting 5.

The number of times that one number of the nozzle 18 can be driven per unit time during movement of the carriage 16, that is, a driving frequency of the nozzles 18 is common to each of the nozzles 18. Each of FIGS. 10 to 13 illustrates an example where one number of the nozzle 18 may be driven with a frequency of one pixel per four pixels that are continuous in the direction D1. Here, in the nozzle region settings 4 to 6 (FIGS. 7 to 9), the number of recording passes for the OC ink is half the number of recording passes for the base color ink. Thus, in nozzle region settings 4 to 6, theoretically the OC ink is recorded for approximately half an area recorded by the base color ink. In FIG. 12, and FIG. 13 to be described later, numbers for "nozzle number as assignment destination/pass number of assignment destination" are not described for half the pixels in the print data 50*oc*, and the pixels are blank. Such blank pixels are pixels that are not allocated to any of the nozzles 18 in the second nozzle used region 41, that is, pixels for which recording is not performed regardless of dot-on or dot-off.

FIG. 13 is a diagram illustrating a corresponding relationship among the pixels constituting the print data 50, passes as assignment destinations, and the nozzles 18, when the nozzle region setting 5 in FIG. 8 is employed as a setting for a nozzle region. In FIG. 13 and FIG. 12, for the print data 50*k*, assignment of each pixel to a pass and the nozzle 18 is exactly identical. On the other hand, for the print data 50*oc*, according to FIG. 13, pixels constituting the unit region data 63 are assigned to the nozzles 18 in the second nozzle used region 41 (nozzle numbers #6 to #15) in the nozzle region setting 5 (FIG. 8) corresponding to any of sixth and seventh passes of two passes in total. In other words, according to FIG. 13, for recording the unit region data 63 on the recording medium 30, a fifth pass is an empty pass. Similarly, according to FIG. 13, pixels constituting the print data 50*oc* of the unit region data 64 are assigned to the nozzles 18 in the second nozzle used region 41 (nozzle numbers #6 to #15) in the nozzle region setting 5 (FIG. 8) corresponding to any of seventh and eighth passes of two passes in total. In other words, according to FIG. 13, for recording the unit region data 64 on the recording medium 30, the sixth pass is an empty pass.

Regarding a relationship among the pixels of the print data 50, the passes as assignment destinations, and the nozzles 18, corresponding to the nozzle region setting 3 in FIG. 6, the nozzle number is merely shifted in accordance with a difference in out-of-target nozzles from the nozzle region setting 2 in FIG. 5, thus description thereof is omitted.

Similarly, regarding a relationship among the pixels of the print data 50, the passes as assignment destinations, and the nozzles 18, corresponding to the nozzle region setting 6 in FIG. 9, the nozzle number is merely shifted in accordance with a difference in out-of-target nozzles from the nozzle region setting 5 in FIG. 8, thus description thereof is omitted.

In FIGS. 10 to 13, regarding the print data 50*k* for the K ink among the base color inks, the relationship among the pixels, the passes as assignment destinations, and the nozzles 18 has been described. For print data of each of the other C, M, Y inks that are the base color inks, a similar description as in the print data 50*k* for the K ink is applied as well.

In step S140, the control unit 11 causes the carriage 16 to repeatedly perform each pass, that is, forward movement and backward movement, at a predetermined movement speed. Also, depending on the setting for the nozzle region in step S130, the control unit 11, based on the assignment relationship as illustrated in any of FIGS. 10 to 13, in accordance with a timing of each pass, transfers dot-on/dot-off information for the pixels constituting the print data to the nozzles 18 in the nozzle rows 19*k*, 19*c*, 19*m*, 19*y*, and 19*oc* for each ink type. Accordingly, as the carriage 16 moves, discharge of the base color ink from the nozzles 18 in the first nozzle used region 40, and discharge of the OC ink from the nozzles 18 in the second nozzle used region 41 are performed. Furthermore, the control unit 11 controls the transport unit 15, at a timing between a pass and a pass, to perform transport of the recording medium 30 in a feed amount in accordance with the setting for the nozzle region in step S130. The recording medium 30 transported by the transport unit 15 is the recording medium 30 of a type set by the user.

As a result of such recording control, for the recording medium 30, an object represented by print data is recorded with the base color ink, and the OC ink is recorded on the base color ink.

3. Summary:

The OC ink is recorded on the base color ink to suppress reflection and diffusion of light, thereby increasing the concentration of black that the base color ink reproduces on the recording medium 30. The OC ink is desirably formed as thin and smooth as possible, in order to provide a more effective effect of suppressing the reflection and diffusion of light. However, in situations where drying of the base color ink is not sufficient, when the OC ink is discharged onto the base color ink, a dot of the OC ink penetrates between dots of the concavo-convex base color ink before drying, and the like, spread of the dot of the OC ink on the base color ink is inhibited. Since the spread of the dot of the OC ink on the base color ink is inhibited, thickness and unevenness of the OC ink are more likely to occur, and as a result, an effect of increasing the black concentration is reduced.

In the present exemplary embodiment, the recording device 10 includes the recording head 17 in which the first nozzle row in which the first nozzles configured to discharge the first ink representing black by a single color or a mixed color are arranged, and the second nozzle row in which the second nozzles configured to discharge the second ink having a lower pigment concentration than a black ink and being an achromatic color are arranged, are arranged and included in the first direction (direction D1), the carriage 16 on which the recording head 17 is mounted, and the carriage being configured to move in the first direction, the transport unit 15 configured to transport the recording medium 30 receiving ink discharged from the recording head 17, in the second direction (direction D2) that intersects with the first direction, and the control unit 11 configured to control the recording head 17, the carriage 16, and the transport unit 15. Then the control unit 11, when, of the first mode that is the recording mode for increasing the concentration of black, and the second mode that is the different recording mode from the first mode, selecting the first mode, in the second direction, provides the nozzle unused region 42 by the first nozzle not discharging the first ink and the second nozzle not discharging the second ink, between the first nozzle used region 40 of the first nozzle row in which the first ink is discharged onto the recording medium 30, and the second nozzle used region 41 of the second nozzle row in which the second ink is discharged onto a region of the recording medium 30 onto which the first ink is discharged, to perform recording on the recording medium 30.

According to the above configuration, the control unit 11 provides the nozzle unused region 42 in the first nozzle row and the second nozzle row. Accordingly, the drying time of the first ink can be ensured before the second ink is discharged by the second nozzle in the second nozzle used region 41, onto the region of the recording medium 30 onto which the first ink is discharged by the first nozzle in the first nozzle used region 40. Thus, the spread of the dot of the second ink on the first ink is not inhibited, and as a result, the effect of increasing the black concentration by the second ink is adequately exhibited.

In addition, according to the above configuration, by providing the nozzle unused region 42, the drying time of the first ink is ensured, and thus the control unit 11 does not need to provide, between a previous pass and a next pass of the carriage 16, a stop time of the carriage 16, for drying ink recorded in the previous pass. By not providing such a stop time, a time required for recording for a sheet of the recording medium 30 can be shortened, and the recording processing can be made efficient.

In a state where the second mode different from the first mode is selected, the control unit 11 does not provide the nozzle unused region 42 between the first nozzle used region 40 and the second nozzle used region 41, in the first nozzle row and the second nozzle row. In the second mode, the control unit 11 discharges, onto a region of the recording medium 30 onto which the first ink is discharged in a certain pass, the second ink in a next pass without an empty pass interposed. Alternatively, the control unit 11 may superimpose and record the first ink and the second ink in a single pass on a certain region of the recording medium 30 in the second mode. Alternatively, the control unit 11 may perform recording without using the second ink in the second mode.

The specific configuration described with reference to each of FIGS. 4 to 13 is only the case included in the present exemplary embodiment, and the inventive concept is not limited to such cases. For example, the number of empty passes determined in step S110 by the control unit 11 is not limited to one or two described above, and may be a number of three or more. Additionally, in step S120, the number of recording passes determined for each of the base color ink and the OC ink is not limited to numbers such as 4 and 2 described above.

Further, according to one aspect of the present exemplary embodiment, the control unit 11, when selecting the first mode, determines the number of nozzles in the second direction (direction D2) in the first nozzle used region 40, and the number of nozzles in the second direction in the second nozzle usage region 41 as an identical number.

According to the above configuration, the control unit 11 can record the second ink with the second nozzles in the second nozzle used region 41, for all of pixels recorded by discharge of the first ink from the first nozzles in the first nozzle used region 40. Accordingly, the effect of increasing the black concentration by the second ink can be further enhanced.

Additionally, according to one aspect of the present exemplary embodiment, the control unit 11, when selecting the first mode, reduces the number of nozzles in the second direction in the second nozzle used region 41, to be less than the number of nozzles in the second direction (direction D2) in the first nozzle usage region 40.

According to the above configuration, the control unit 11 can reduce the number of passes in total required for recording the first ink and the second ink on the recording medium 30. This reduces a time required for recording on the recording medium 30.

Additionally, according to one aspect of the present exemplary embodiment, the control unit 11 changes the number of empty passes required for drying the first ink, in accordance with a type of the recording medium 30. That is, in accordance with the type of the recording medium 30, the number of nozzles in the second direction (direction D2) in the nozzle unused region 42 is changed.

The number of nozzles in the second direction in the nozzle unused region 42 affects a length of the drying time of the first ink. Thus, according to the above configuration, the control unit 11 can adjust the drying time of the first ink appropriately, by changing the number of nozzles in the second direction in the nozzle unused region 42 in accordance with the type of the recording medium 30. The control unit 11, for example, sets the number of nozzles in the second direction in the nozzle unused region 42 to be small, when recording is performed on the recording medium 30 of a type where ink fixing or penetration is relatively fast.

Additionally, the present exemplary embodiment discloses a recording method for recording on the recording medium 30 by controlling, the recording head 17 in which the first nozzle row in which the first nozzles configured to discharge the first ink representing black by a single color or a mixed color are arranged, and the second nozzle row in which the second nozzles configured to discharge the second ink having a lower pigment concentration than a black ink and being an achromatic color are arranged, are arranged and included in the first direction (direction D1), the carriage 16 on which the recording head 17 is mounted, and the carriage being configured to move in the first direction, and the transport unit 15 configured to transport the recording medium 30 receiving ink discharged from the recording head 17, in the second direction (direction D2) that intersects with the first direction. According to this recording method, when, of the first mode that is the recording mode for increasing the concentration of black, and the second mode that is the different recording mode from the first mode, the first mode is selected, in the second direction, the nozzle unused region 42 by the first nozzle not discharging the first ink and the second nozzle not discharging the second ink is provided, between the first nozzle used region 40 of the first nozzle row by the first nozzle discharging the first ink onto the recording medium 30, and the second nozzle used region 41 of the second nozzle row by the second nozzle discharging the second ink onto a region of the recording medium 30 onto which the first ink is discharged, to perform recording on the recording medium 30.

4. Other Description:

The nozzle 18 may be clogged due to an increase in viscosity of ink, inclusion of bubbles, or the like. When the nozzle 18 is clogged, even though the control unit 11 controls and performs discharge of ink from the nozzle 18, a defective recording point for a dot, or a "missing dot" appears in a recording result on the recording medium 30, since the ink is not actually discharged, or a required amount of the ink is not discharged. A method of inspecting whether or not the nozzle 18 corresponds to a defective nozzle where ink discharge is defective due to clogging or the like is known. For example, by driving each of the nozzles 18 to evaluate a missing dot on a test pattern recorded on a recording medium, or by driving each of the nozzles 18 to evaluate a signal waveform generated for a driving element of each of the nozzles 18, it is possible to inspect whether each of the nozzles 18 corresponds to a defective nozzle or not.

The control unit 11 acquires an inspection result of whether each of the nozzles 18 corresponds to a defective nozzle or not, according to any of the inspection methods. The control unit 11, when a defective nozzle is included in the first nozzle row and/or the second nozzle row, may provide the nozzle unused region 42 such that the defective nozzle is included in the nozzle unused region 42.

For example, assume a scene in which the control unit 11 based on the determination of the number of empty passes and the number of recording passes in steps S110 and S120, employs either the nozzle region setting 2 illustrated in FIG. 5 or the nozzle region setting 3 illustrated in FIG. 6 in step S130. In this case, the control unit 11 employs, of the nozzle region setting 2 and the nozzle region setting 3, the setting for which a larger number of defective nozzles is included in the nozzle unused region 42. For example, assume that the nozzle 18 with the nozzle number #23 in the nozzle row 19*k* for the K ink is a defective nozzle. This defective nozzle, according to the nozzle region setting 2, belongs to the nozzle unused region 42, and according to the nozzle region setting 3, belongs to the first nozzle usage region 40 without belonging to the nozzle unused region 42. Accordingly, in this case, the control unit 11 employs the nozzle region setting 2.

It is sufficient that, based on the determination of the number of empty passes and the number of recording passes in step S110 and S120, and, even when either the nozzle region setting 5 illustrated in FIG. 8 or the nozzle region setting 6 illustrated in FIG. 9 is employed, the control unit 11 employs the setting for which a larger number of defective nozzles are included in the nozzle unused region 42 in step S130. In any case, when a defective nozzle is included in the first nozzle row or the second nozzle row, the control unit 11 sets a position of the nozzle unused region 42 and the number of nozzles so that the nozzle unused region 42 includes the defective nozzle as possible. Accordingly, an effect of the defective nozzle can be eliminated as possible from a recording result on the recording medium 30.

The present exemplary embodiment is applicable to both uni-directional recording and bi-directional recording.

The uni-directional recording is a process in which recording on the recording medium 30 by the recording head 17 is performed, only by one of forward movement and backward movement of the carriage 16, for example, only by the forward movement. When the uni-directional recording is assumed, the control unit 11 provides the nozzle region as described above corresponding to the forward movement, and causes the recording head 17 to discharge the first ink and the second ink onto the recording medium 30 in the forward movement. On the other hand, for the backward movement, the control unit 11 performs a complete empty pass. A complete empty pass is a pass in which all of the nozzles 18 of the recording head 17 are not caused to discharge ink. The control unit 11 causes the transport unit 15 to perform transport of the recording medium 30 in a feed amount, after ending forward movement and before starting next forward movement.

The bi-directional recording is a process for performing recording on the recording medium 30 by the recording head 17 both in forward movement and backward movement of the carriage 16. When the bi-directional recording is assumed, the control unit 11 applies the setting for the nozzle region as described above to both the forward movement and the backward movement, and causes the recording head 17 to discharge the first ink and the second ink onto the recording medium 30. The control unit 11 causes the transport unit 15 to perform transport of the recording medium 30 in a feed amount, after ending forward movement and before starting next backward movement. In addition, the control unit 11 causes the transport unit 15 to perform transport of the recording medium 30 in the feed amount, after ending backward movement and before starting next forward movement.

Heretofore, the description has been given assuming that the second ink that is the OC ink is recorded at a different timing from that for the first ink. However, the second ink may also be recorded at a timing similar to that for the first ink. For example, when an LLK ink is used as the OC ink, the control unit 11 causes the recording head 17 to discharge the C, M, Y, K, and LLK inks on the recording medium 30 as the base color inks in a certain pass. Thereafter, in another pass, the recording head 17 is caused to discharge the LLK ink as the OC ink on the base color ink onto the recording medium 30.

What is claimed is:

1. A recording device, comprising:

a recording head including a first nozzle row, in which first nozzles configured to discharge a first ink representing black by a single color or a mixed color, are arranged, and a second nozzle row, in which second nozzles configured to discharge a second ink having a lower pigment concentration than a black ink and being an achromatic color, are arranged, the first nozzle row and the second nozzle row being arranged in a first direction;

a carriage on which the recording head is mounted, and the carriage being configured to move in the first direction;

a transport unit configured to transport a recording medium, that receives ink discharged from the recording head, in a second direction that intersects with the first direction;

an operation accepting unit configured to accept an operation by a user, the operation accepting unit being configured to accept, from the user, setting of setting information that is related to a recording processing and includes a recording quality; and a control unit configured to control the recording head, the carriage, and the transport unit, the control unit being further configured to acquire the setting information that has been set by the user through the operation accepting unit, wherein when, of a first mode that is a recording mode for increasing concentration of black and a second mode that is a different recording mode from the first mode, the first mode is selected, the control unit sets, using the setting information, the number of the nozzles, in the second direction, in a first nozzle used region of the first nozzle row for discharging the first ink onto the recording medium, the number of the nozzles, in the second direction, in a second nozzle used region of the second nozzle row for discharging the second ink onto a region of the recording medium with the first ink discharged thereon, and the number of the nozzles, in the second direction, in a nozzle unused region in which the first nozzle does not discharge the first ink and the second nozzle does not discharge the second ink, to set the first nozzle used region, the second nozzle used region, and the nozzle unused region, and the control unit performs recording on the recording medium with the nozzle unused region set between, in the second direction, the first nozzle used region and the second nozzle used region.

2. The recording device according to claim 1, wherein the control unit, when the first mode is selected, causes the number of the nozzles, in the second direction, in the first nozzle used region, and the number of the nozzles, in the second direction, in the second nozzle used region to be identical.

3. The recording device according to claim 1, wherein the control unit, when the first mode is selected, causes the number of the nozzles, in the second direction, in the second nozzle used region to be smaller than the number of the nozzles, in the second direction, in the first nozzle used region.

4. The recording device according to claim 1, wherein the control unit changes the number of the nozzles, in the second direction, in the nozzle unused region according to a type of the recording medium.

5. A recording device , comprising:

a recording head including a first nozzle row, in which first nozzles configured to discharge a first ink representing black by a single color or a mixed color, are arranged, and a second nozzle row, in which second nozzles configured to discharge a second ink having a lower pigment concentration than a black ink and being an achromatic color, are arranged, the first nozzle row and the second nozzle row being arranged in a first direction;

a carriage on which the recording head is mounted, and the carriage being configured to move in the first direction;

a transport unit configured to transport a recording medium, that receives ink discharged from the recording head, in a second direction that intersects with the first direction; and a control unit configured to control the recording head, the carriage, and the transport unit, wherein when, of a first mode that is a recording mode for increasing concentration of black and a second mode that is a different recording mode from the first mode, the first mode is selected, the control unit performs recording on the recording medium with a nozzle unused region, in which the first nozzle does not discharge the first ink and the second nozzle does not discharge the second ink, set between, in the second direction, a first nozzle used region of the first nozzle row for discharging the first ink onto the recording medium, and a second nozzle used region of the second nozzle row for discharging the second ink onto a region of the recording medium with the first ink discharged thereon, and the control unit, when a defective nozzle with poor ink discharge is included in the first nozzle row and/or the second nozzle row, sets the nozzle unused region such that the defective nozzle is included in the nozzle unused region.

6. A recording method for performing recording on the recording medium by controlling a recording head, a carriage on which the recording head is mounted, and the carriage being configured to move in a first direction, a transport unit configured to transport a recording medium, that receives ink discharged from the recording head, in a second direction that intersects with the first direction, and an operation accepting unit configured to accept an operation by a user, the operation accepting unit being configured to accept, from the user, setting of setting information that is related to a recording processing and includes a recording quality, wherein the recording head includes a first nozzle row, in which first nozzles configured to discharge a first ink representing black by a single color or a mixed color are arranged, and a second nozzle row, in which second nozzles configured to discharge a second ink having a lower pigment concentration than a black ink and being an achromatic color are arranged, and the first nozzle row and the second nozzle row are arranged in the first direction, and when, of a first mode that is a recording mode for increasing concentration of black, and a second mode that is a different recording mode from the first mode, the first mode is selected, the recording method comprises setting, using the setting information, the number of the nozzles, in the second direction, in a first nozzle used region of the first nozzle row for discharging the first ink onto the recording medium, the number of the nozzles, in the second direction, in a second nozzle used region of the second nozzle row for discharging the second ink onto a region of the recording medium with the first ink discharged thereon, and the number of the nozzles, in the second direction, in a nozzle unused region in which the first nozzle does not discharge the first ink and the second nozzle does not discharge the second ink, to set the first nozzle used region, the second nozzle used region, and the nozzle unused region; and recording on the recording medium with the nozzle unused region set between, in the second direction, the first nozzle used region and the second nozzle used region.

7. The recording device according to claim 1, wherein the control unit, when the first mode is selected, upon acquiring the setting information with a first recording quality that has higher recording quality than a second recording quality, sets the number of the nozzles in the first nozzle used region and the number of the nozzles in the second nozzle used region such that the number of the nozzles in the first nozzle used region is less than the number of the nozzles in the first nozzle used region when the setting information with the second recording quality is acquired, and such that the number of the nozzles in the second nozzle used region is greater than the number of the nozzles in the second nozzle used region when the setting information with the second recording quality is acquired.

* * * * *